US009360810B2

(12) United States Patent
Shimmura et al.

(10) Patent No.: US 9,360,810 B2
(45) Date of Patent: Jun. 7, 2016

(54) FIXING DEVICE AND FIXING TEMPERATURE CONTROL METHOD OF FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Shoko Shimmura, Yokohama Kanagawa (JP); Osamu Takagi, Chofu Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/716,094

(22) Filed: May 19, 2015

(65) Prior Publication Data

US 2015/0331376 A1 Nov. 19, 2015

(30) Foreign Application Priority Data

May 19, 2014 (JP) ..... 2014-103771

(51) Int. Cl.
*G03G 15/20* (2006.01)

(52) U.S. Cl.
CPC ..... *G03G 15/2078* (2013.01); *G03G 15/2042* (2013.01); *G03G 15/2053* (2013.01); *G03G 2215/2022* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,323,460 | B1 * | 11/2001 | Ohtsuka | 219/216 |
| 6,336,009 | B1 * | 1/2002 | Suzumi et al. | 399/67 |
| 6,423,941 | B1 * | 7/2002 | Kanari et al. | 219/216 |
| 7,424,260 | B2 | 9/2008 | Nishiyama et al. | |
| 7,512,370 | B2 | 3/2009 | Shimizu et al. | |
| 2007/0237536 | A1 * | 10/2007 | Roof et al. | 399/69 |

* cited by examiner

*Primary Examiner* — Clayton E LaBalle
*Assistant Examiner* — Jas Sanghera
(74) *Attorney, Agent, or Firm* — Amin, Turocy & Watson LLP; Gregory Turocy

(57) ABSTRACT

According to one embodiment, a fixing device includes determination means for determining the size of a medium, heating means for including plural heat-generating members which are two-dimensionally arranged such that the heat-generating members are lined up along two parallel lines or more which are vertical to a transport direction of the medium and divided at locations on the parallel lines, and are disposed so as to come into contact with an inner side of the rotating body, and a switching unit which switches individual conduction, and heats the medium, pressing means for forming a nip by performing pressing and contact at a position of the plural heat-generating members, and heating control means for selecting a group of the heat-generating members which are lined up in the two-dimensional arrangement, conducting the selected group of the heat-generating members, and controlling the heating means.

5 Claims, 17 Drawing Sheets

FORM HEAT-GENERATING RESISTOR LAYER ON SUBSTRATE

PERFORM MASKING WITH ALUMINIUM LAYER

FIXING DEVICE AND FIXING TEMPERATURE CONTROL METHOD OF FIXING DEVICE

CROSS-REFERENCE TO RELATED APPLICATION

This application is based upon and claims the benefit of priority from Japanese Patent Application No. 2014-103771, filed May 19, 2014, the entire contents of which are incorporated herein by reference.

FIELD

Embodiments described herein relate generally to a fixing device and a fixing temperature control method of the fixing device.

BACKGROUND

In the related art, a lamp which is representatively a halogen lamp and generates infrared rays, or a method of performing heating with Joule's heating by using electromagnetic induction, is put into practical use as a heat source of a fixing device which is mounted in an image forming apparatus. In this heating method, a time for warming up the entirety of a fixing device and a lot of electrical energy are required. There is a problem that heat which is generated in the fixing device is transferred to other units of an image forming apparatus, and thus malfunction occurs.

Recently, a reduction of time taken to start the device, energy saving, prevention of excessive heat generation, and the like also become critical issues. Accordingly, a method as follows is proposed. Two heat-generating resistors having resistance values different from each other are provided in a fixing device. The heat-generating resistors are respectively connected to power supply systems which are different from each other, and thus one heat-generating resistor is constantly conducted and the fixing device is pre-heated during a time when the fixing device is on standby. With such a structure, good fixation characteristics of allowing an optimal temperature gradient in a fixing nip to be realized corresponding to various sizes of recording paper are obtained.

However, in the above-described structure of the device in the related art, when small-sized paper and large-sized paper are mixed and supplied, it is difficult to delicately control power, which is required to be supplied to a heater, to be minimized at both end portions of the heater and at the center portion.

An example of the related art includes JP-A-2000-243537.

DETAILED DESCRIPTION

Considering the above-described problems, an object of exemplary embodiments is to provide a fixing device and a fixing temperature control method of the fixing device which enables a paper passing area to be stably heated in a concentrated manner and in which it is possible to obtain improvement of fixing quality and energy saving even though small-sized paper and large-sized paper are mixed and supplied.

In general, according to one embodiment, a fixing device includes determination means, heating means, pressing means, and heating control means. The determination means is configured to determine the size of a medium on which a toner image is formed. The heating means is configured to include an endless rotating body, a plurality of heat-generating members, and a switching unit, and to heat the medium. The plurality of heat-generating members are two-dimensionally arranged in such a manner that the heat-generating members are lined up along two parallel lines or more which are vertical to a transport direction of the medium and divided at locations on the parallel lines corresponding to each other, and are disposed so as to come into contact with an inner side of the rotating body. The switching unit switches individual conduction of these heat-generating members. The pressing means is configured to form a nip by performing pressing and contact at a position of the plurality of heat-generating members in the heating means, and to nip and carry the medium in the transport direction with the heating means. The heating control means is configured to select a group of the heat-generating members which corresponds to a position through which the medium passes based on the size of the medium which is determined by the determination means, the group of the heat-generating members being lined up in the transport direction in the two-dimensional arrangement, to conduct the selected group of the heat-generating members by the switching unit, and to control the heating means to heat the medium at the same time.

Embodiment 1

Figure 1:
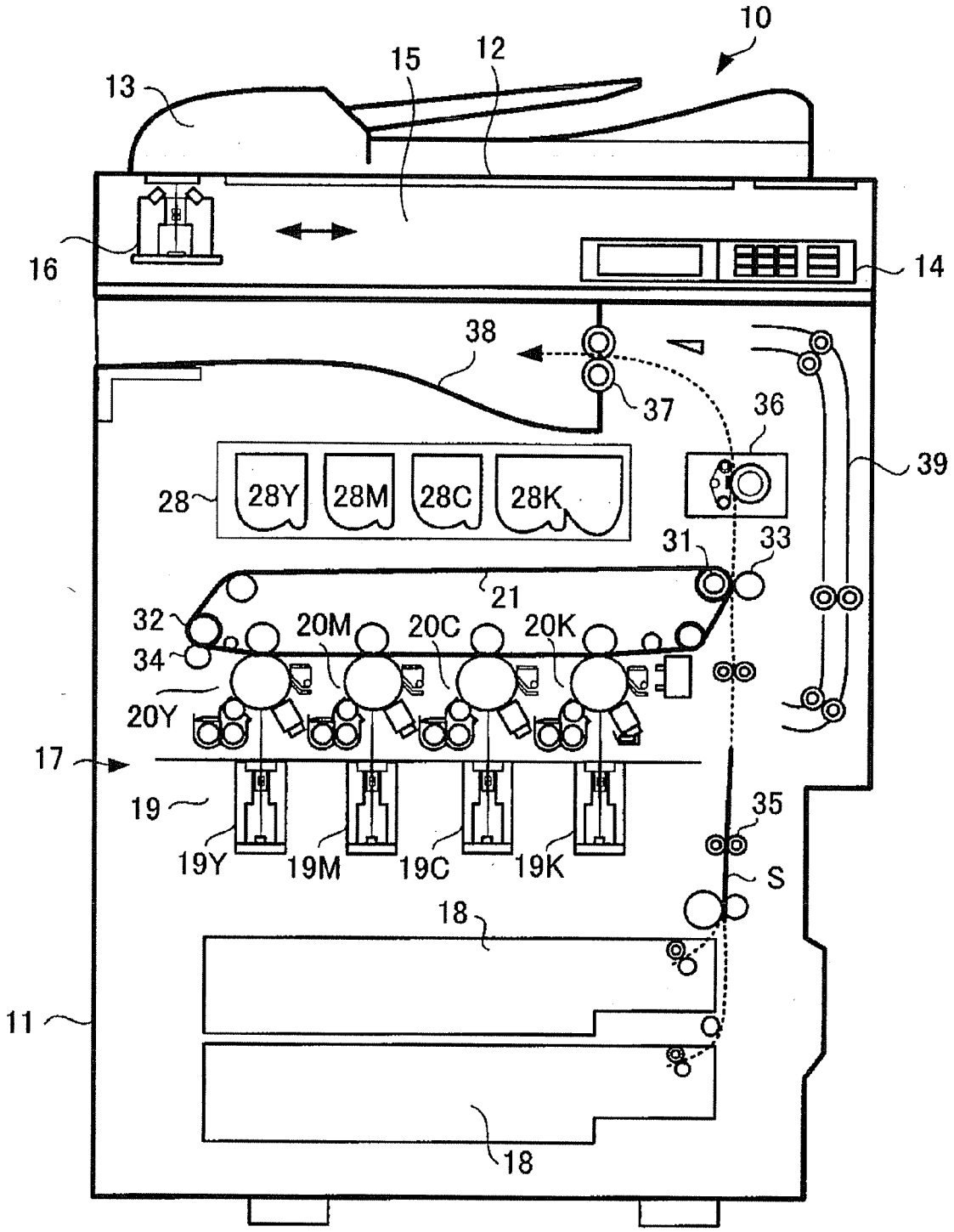
FIG. 1 is a diagram illustrating a configuration example of an image forming apparatus in which a fixing device according to Embodiment 1 is mounted.

FIG. 1 is a diagram illustrating a configuration example of an image forming apparatus in which a fixing device according to Embodiment 1 is mounted. In FIG. 1, the image forming apparatus 10 is, for example, a combined machine such as a multifunction peripheral (MFP), a printer, and a copier. In the following descriptions, an MFP is used as an example.

There is a manuscript stand 12 of transparent glass on an upper portion of a main body 11 in the MFP 10. An automatic document feeder (ADF) 13 is provided on the manuscript stand 12 to be freely opened and closed. An operation panel 14 is provided on the upper portion of the main body 11. The operation panel 14 includes various keys and a touch panel type display unit.

A scanner unit 15 which is a reading device is provided under the ADF 13 in the main body 11. The scanner unit 15 reads an original document which is fed by the ADF 13 or an original document which is placed on the manuscript stand, and generates image data. Thus, the scanner unit 15 includes a contact type image sensor 16 (simply referred to as an image sensor below). The image sensor 16 is disposed in a main scanning direction (depth direction in FIG. 1).

The image sensor 16 reads an original document image line by line while moving along the manuscript stand 12 when reading an image of an original document which is placed on the manuscript stand 12. This operation is performed over the entire size of the original document and thus reading the original document for one page is performed. When reading an image of an original document which is fed by the ADF 13, the image sensor 16 has a fixed position (illustrated position).

A printer unit 17 is included in the center portion of the main body 11. A plurality of paper cassettes 18 which are for storing various sizes of paper P are included in a lower portion of the main body 11. The printer unit 17 includes a photoconductive drum and a scanning head 19 which includes an LED as an exposing device. The printer unit 17 scans a photoconductor with light beams from the scanning head 19 and generates an image.

The printer unit 17 processes image data which is read by the scanner unit 15, or image data which is created by a personal computer or the like, and forms an image on paper. The printer unit 17 is, for example, a tandem type color laser printer and includes an image forming unit 20Y for yellow (Y), an image forming unit 20M for magenta (M), an image forming unit 20C for cyan (C), and an image forming unit 20K for black (K). The image forming units 20Y, 20M, 20C, and 20K are disposed in parallel on a lower side of an intermediate transfer belt 21 along a downstream side from an upstream side. The scanning head 19 also includes a plurality of scanning heads 19Y, 19M, 19C, and 19K respectively corresponding to the image forming units 20Y, 20M, 20C, and 20K.

Figure 2:
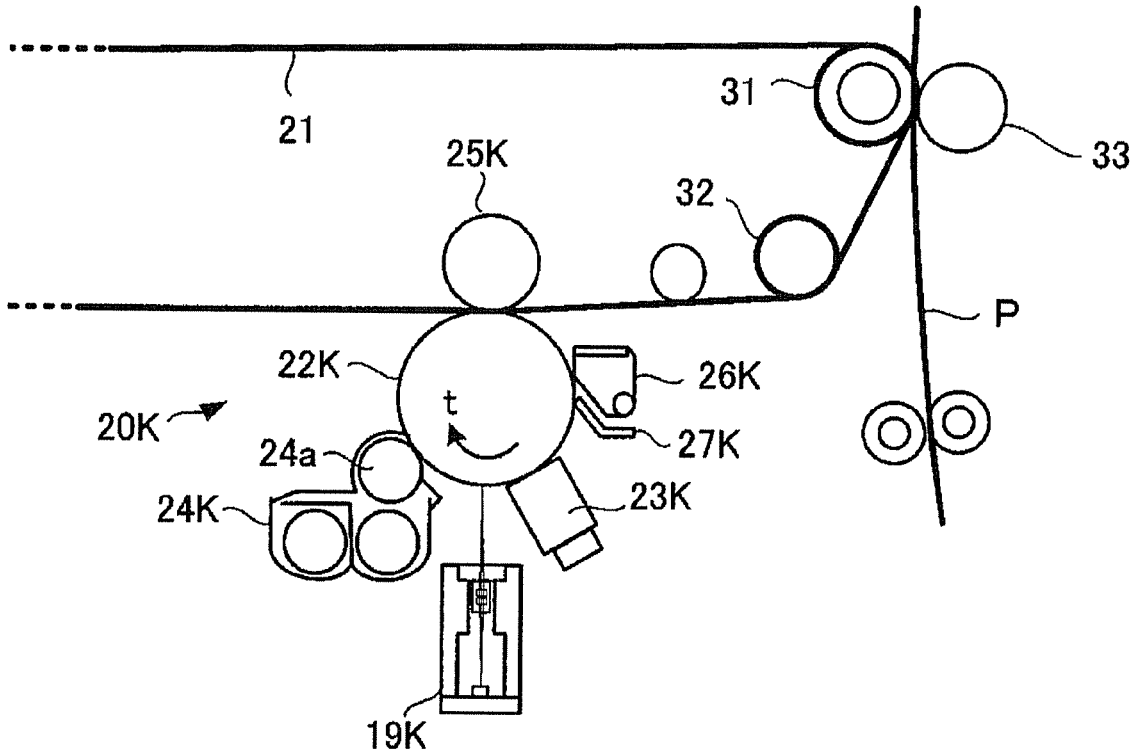
FIG. 2 is a configuration diagram illustrating a partially enlarged portion of the image forming unit according to Embodiment 1.

FIG. 2 is a configuration diagram illustrating the image forming unit 20K which is enlarged among the image forming units 20Y, 20M, 20C, and 20K. Since the image forming units 20Y, 20M, 20C, and 20K have the same configuration in the following descriptions, descriptions will be made by using the image forming unit 20K as an example.

The image forming unit 20K includes a photoconductive drum 22K which is an image carrying body. A charger 23K, a developing device 24K, a primary transfer roller (transferring device) 25K, a cleaner 26K, a blade 27K, and the like are disposed around the photoconductive drum 22K along a rotation direction t. An exposure position of the photoconductive drum 22K is irradiated with light from the scanning head 19K and thus an electrostatic latent image is formed on the photoconductive drum 22K.

The charger 23K of the image forming unit 20K causes a surface of the photoconductive drum 22K to be uniformly charged. The developing device 24K supplies a two-component developer which contains black toner and carriers to the photoconductive drum 22K by using a developing roller 24*a* to which developing bias is applied, and develops the electrostatic latent image. The cleaner 26K removes a residual toner on a surface of the photoconductive drum 22K by using the blade 27K.

As illustrated in FIG. 1, a toner cartridge 28 for supplying a toner to each of the developing devices 24Y to 24K is provided over the image forming units 20Y to 20K. The toner cartridge 28 includes toner cartridges for yellow (Y), magenta (M), cyan (C), and black (K).

The intermediate transfer belt 21 moves circularly. The intermediate transfer belt 21 crosses over a driving roller 31 and a driven roller 32. The intermediate transfer belt 21 faces and comes into contact with the photoconductive drums 22Y to 22K. A primary transfer voltage is applied to a position of the intermediate transfer belt 21 facing the photoconductive drum 22K by the primary transfer roller 25K, and a toner image on the photoconductive drum 22K is primarily transferred to the intermediate transfer belt 21.

A secondary transfer roller 33 is disposed to face the driving roller 31 over which the intermediate transfer belt 21 crosses. When the paper P passes through between the driving roller 31 and the secondary transfer roller 33, a secondary transfer voltage is applied to the paper P by the secondary transfer roller 33. Thus, the toner image on the intermediate transfer belt 21 is secondarily transferred to the paper P. A belt cleaner 34 is provided in the vicinity of the driven roller 32 of the intermediate transfer belt 21.

As illustrated in FIG. 1, a feeding roller 35 for transporting the paper P which is taken out from the paper cassette 18 is provided in the middle of a path from the paper cassette 18 to the secondary transfer roller 33. A fixing device 36 is provided downstream of the secondary transfer roller 33. A transporting roller 37 is provided downstream of the fixing device 36. The transporting roller 37 discharges the paper P to a paper discharge unit 38. A reverse transport path 39 is provided downstream of the fixing device 36. The reverse transport path 39 is for causing the paper P to be reversed and introducing the reversed paper P in a direction of the secondary transfer roller 33. Thus, the reverse transport path 39 is used when double-sided printing is performed.

FIGS. 1 and 2 illustrate an example of the embodiment. A structure of the image forming apparatus part except for the fixing device 36 is not limited thereto and a structure of a known electrophotographic type image forming apparatus may be used.

Figure 3:
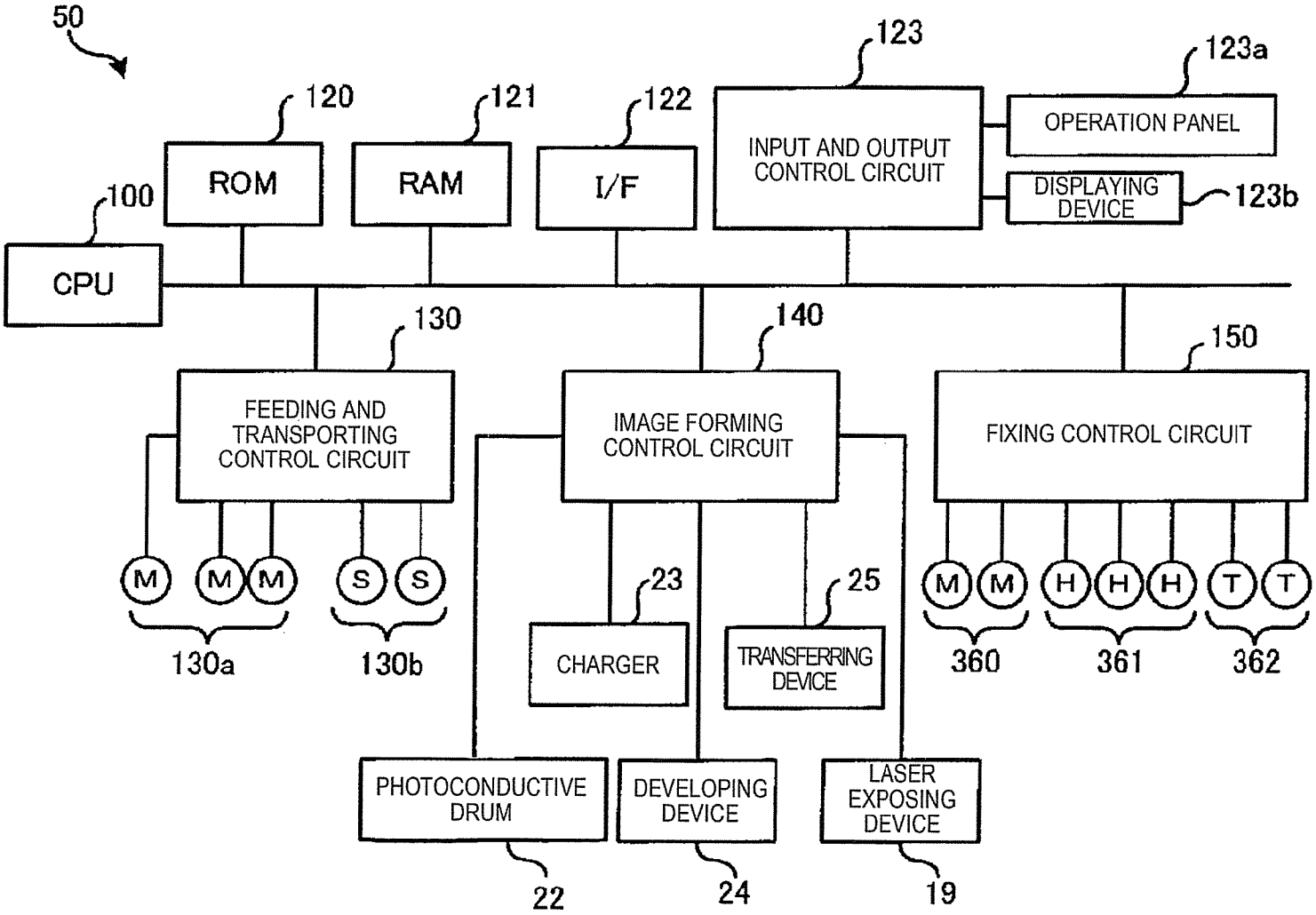
FIG. 3 is a block diagram illustrating a configuration example of a control system in an MFP according to Embodiment 1.

FIG. 3 is a block diagram illustrating a configuration example of a control system 50 of the MFP 10 according to Embodiment 1. The control system 50 includes a CPU 100 for controlling the entire MFP 10, a read only memory (ROM) 120, a random access memory (RAM) 121, an interface (I/F) 122, an input and output control circuit 123, a feeding and transporting control circuit 130, an image forming control circuit 140, and a fixing control circuit 150, for example.

The CPU 100 implements processing functions for image forming by executing a program which is stored in the ROM 120 or the RAM 121. The ROM 120 stores a control program, control data, and the like for causing basic operations in image forming processing to be performed. The RAM 121 is a working memory. The ROM 120 (or the RAM 121) stores, for example, a control program for the image forming unit 20 or the fixing device 36 and various types of control data which are used by the control program. In this embodiment, a specific example of the control data includes a correspondence relationship of a paper size and the heat-generating member to be conducted, or a correspondence relationship of a basis weight of a paper and values of a surface temperature of the heat-generating member and an outdoor air temperature, and the heat-generating member which is to be conducted, and the like. The basis weight and values may be detected by various sensors in the MFP 10.

A fixing temperature control program of the fixing device 36 includes determination logic and heating control logic. The determination logic is for determining the size, the thickness, and the basis weight of paper, and values of a surface temperature of the heat-generating member, an outdoor air temperature, and the like based on a detection signal of a sensor in the MFP 10 and the like. The heating control logic is for selecting the heat-generating members corresponding to a position through which paper passes and causing the selected heat-generating members to be conducted under control of a driving IC and controlling heating in the heating section. A specific example of the driving IC which is a switching unit of the heat-generating member includes a switching element, an FET, a TRIAC, a switching IC, and the like.

The I/F 122 causes a user terminal and various devices such as a facsimile to communicate with each other. The input and output control circuit 123 controls an operation panel 123*a*, and a displaying device 123*b*. The feeding and transporting control circuit 130 controls a motor group 130*a* which drives the feeding roller 35 or the transporting roller 37 on a transport path, and the like. The feeding and transporting control circuit 130 controls the motor group 130*a* and the like based on a control signal from the CPU 100 considering a sensing result of various sensors 130*b* in the vicinity of the paper cassette 18 or on the transport path. The image forming control circuit 140 controls the photoconductive drum 22, a charger 23, the laser exposing device 19, a developing device 24, and a transferring device 25 based on a control signal from the CPU 100. The fixing control circuit 150 controls a driving motor 360 of the fixing device 36, a heating member 361, a temperature sensing member 362 such as a thermistor, and the like based on a control signal from the CPU 100. In this embodiment, a control program of the fixing device 36 and control data are stored in a storage device of the MFP 10 and are executed by the CPU 100. However, a computation device and a storage device which are dedicated for the fixing device 36 may be individually provided.

Figure 4:
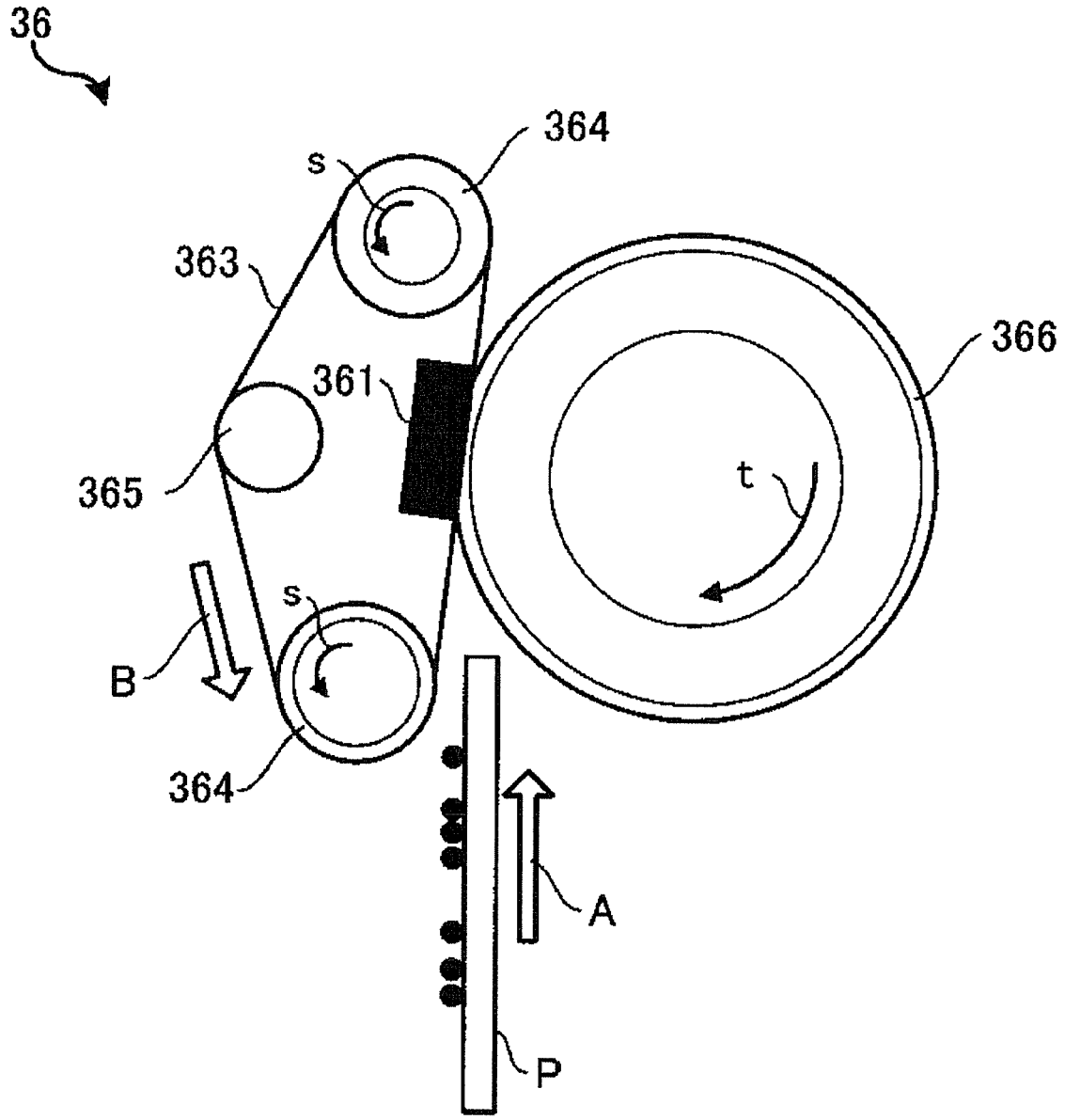
FIG. 4 is a diagram illustrating a configuration example of a fixing device according to Embodiment 1.

FIG. 4 is a diagram illustrating a configuration example of the fixing device 36. In FIG. 4, the fixing device 36 includes the plate-shaped heating member 361, an endless belt 363, a belt transporting roller 364 for driving the endless belt 363, a tension roller 365 for applying tension to the endless belt 363, and a pressing roller 366. The endless belt 363 has an elastic layer and crosses over a plurality of rollers. An elastic layer is formed on a surface of the pressing roller 366. The heat-generating unit side of the heating member 361 is brought into contact with the inner side of the endless belt 363 and is pressed in a direction of the pressing roller 366, and thus the heating member 361 forms a fixing nip having a predetermined width at a portion between the heating member 361 and the pressing roller 366. With a configuration in which the heating member 361 forms a nip area and performs heating, responsiveness when conduction is performed is higher than that when a halogen lamp performs heating.

In the endless belt 363, a silicon rubber layer with a thickness of 200 um is formed on the outer side on an SUS base member with a thickness of 50 um, or on polyimide which is a heat-resistant resin and has a thickness of 70 um, and the outermost circumference is covered with a surface protective layer which is formed of a PFA, and the like, for example. In the pressing roller 366, a silicon sponge layer with a thickness of 5 mm is formed on a surface of an iron rod having 10 mm of ϕ and the outermost circumference is covered with a surface protective layer which is formed of a PFA, and the like, for example.

Figure 5:
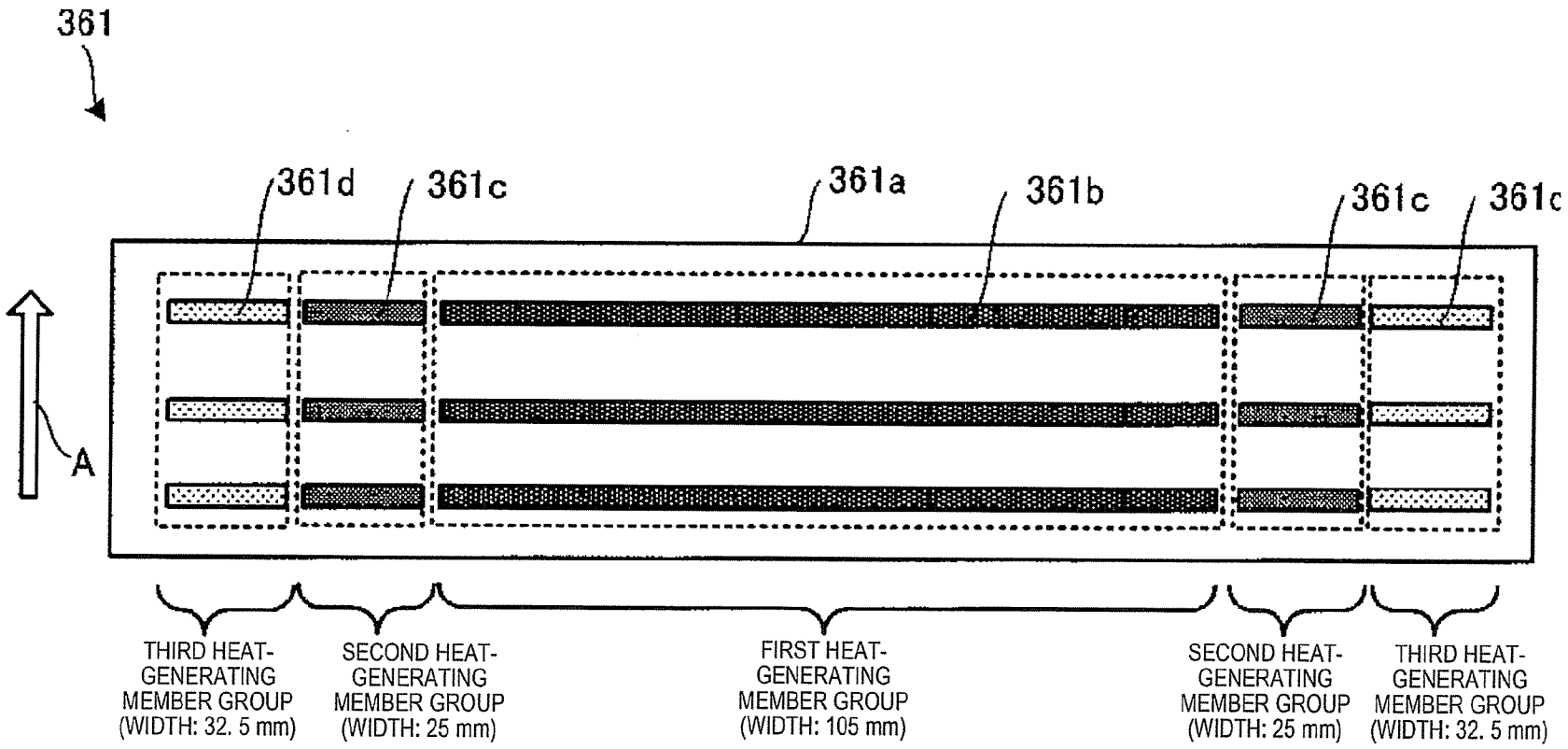
FIG. 5 is an arrangement diagram of heat-generating member groups according to Embodiment 1.

FIG. 5 is an arrangement diagram of heat-generating member groups in this embodiment. The heating member 361 is divided into heat-generating members (heat-generating element) having three length types. The heat-generating members having three length types are for corresponding to a postcard size (100×148 mm), a CD jacket size (121×121 mm), a B5R size (182×257 mm), and an A4R size (210×297 mm) and are classified into three heat-generating member groups. The heat-generating member group is conducted in a heating area to which a margin of about 5% is added considering transporting accuracy of transported paper, skew, and emission of heat to a non-heating portion.

In the example of FIG. 5, a first heat-generating member group is provided at the center portion in the main scanning direction (right and left direction in FIG. 5) and the width of the first heat-generating member group is set to 105 mm in order to correspond to the width of 100 mm of a postcard sized paper which is the minimum size. In order to correspond to the next larger sizes of 121 mm and 148 mm, two second heat-generating member groups are provided on the outside of the first heat-generating member group (right and left direction in FIG. 5), and each of the two second heat-generating member groups has a width of 25 mm. The second heat-generating member groups handle paper having a width up to 155 mm which is 148 mm+5%. In order to correspond to further larger sizes of 182 mm and 210 mm, two third heat-generating member groups are provided on the outside of the second heat-generating member group, and each of the two third heat-generating member groups has a width of 32.5 mm. The third heat-generating member groups handle paper having a width up to 220 mm which is 210 mm+5%.

The number of divisions of the heat-generating member groups and the widths of the divided heat-generating member groups are only an example, and those are not limited thereto. For example, when the MFP 10 handles five medium sizes, the heat-generating member group may be divided into five groups in accordance with the respective medium sizes.

In this embodiment, a line sensor (not illustrated) is disposed in a paper passing area and thus the size and the position of paper which passes through the paper passing area are able to be determined in real time. When a print operation is started, a paper size may be determined by using image data or information of the paper cassette 18 which stores paper in the MFP 10.

Figure 6A:
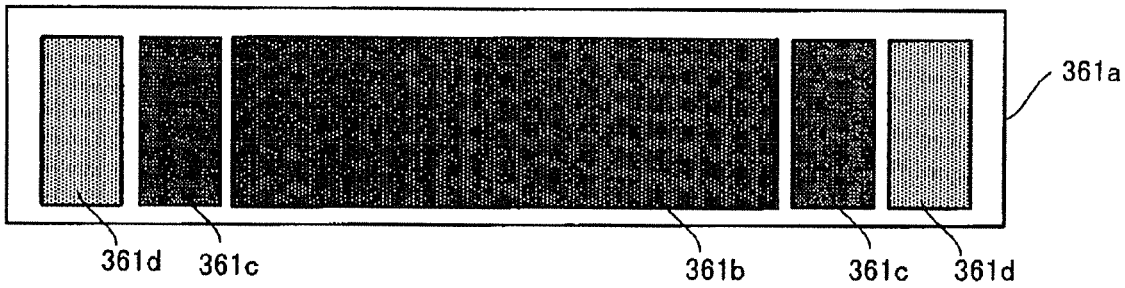
FIGS. 6A and 6B are top views illustrating a forming method of the heat-generating member group according to Embodiment 1.

FIGS. 6A to 7C are top views and side views illustrating a forming method of the heat-generating member group in Embodiment 1. As illustrated in FIGS. 6A and 7A, in the heating member 361, a glazed layer (not illustrated) and heat-generating resistor layers (361*b*, 361*c*, and 361*d*) are stacked on a ceramic substrate 361*a*. The heat-generating resistor layers (361*b*, 361*c*, and 361*d*) are formed of a known material such as $TaSiO_2$, for example. In order to emit residual heat to an opposite side and to prevent bending of the substrate, an aluminium heat sink 361*e* is bonded to a lower side of the ceramic substrate 361*a*.

Figure 7A:
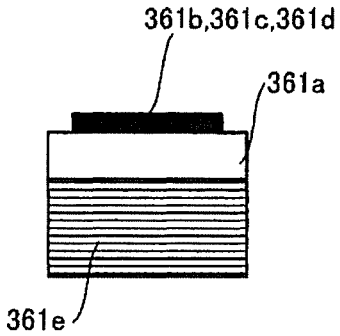
FIGS. 7A to 7C are side views illustrating the forming method of the heat-generating member group according to Embodiment 1.
Figure 7B:
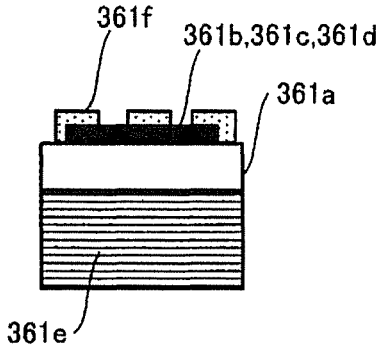

As illustrated in FIG. 7B, a portion between the heat-generating members which are adjacent to each other is insulated and an aluminium layer 361*f* is formed with a pattern in which a plurality of heat-generating resistors are exposed in a paper transport direction. The heat-generating resistor layer is divided by forming the aluminium layer 361*f*. The divided portions have a predetermined length and the number of the divided portions is a predetermined number in the main scanning direction and the paper transport direction and exposure portions have a two-dimensional arrangement. These exposure portions become the heat-generating member. The exposure portions are formed such that the width of each of the exposure portions in the transport direction is narrower than the width of a portion which is masked by the aluminium layer 361*f*, in the transport direction.

Figure 6B:
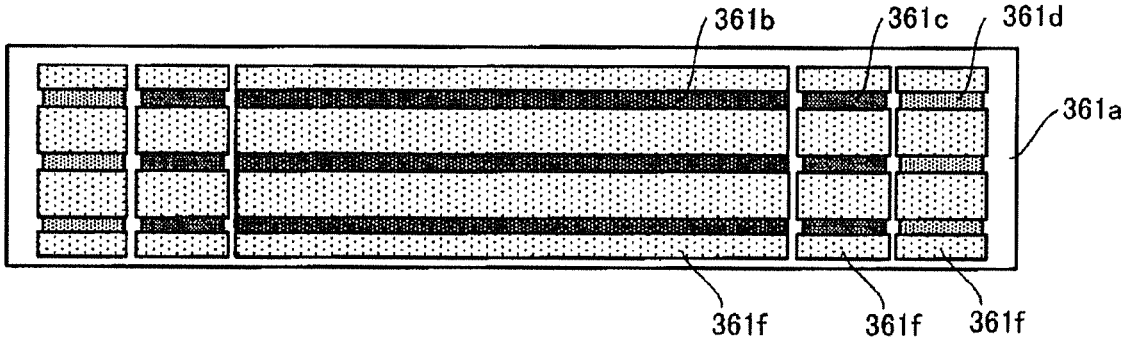
Figure 7C:
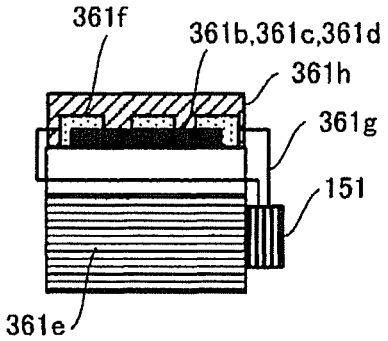
Figure 8:
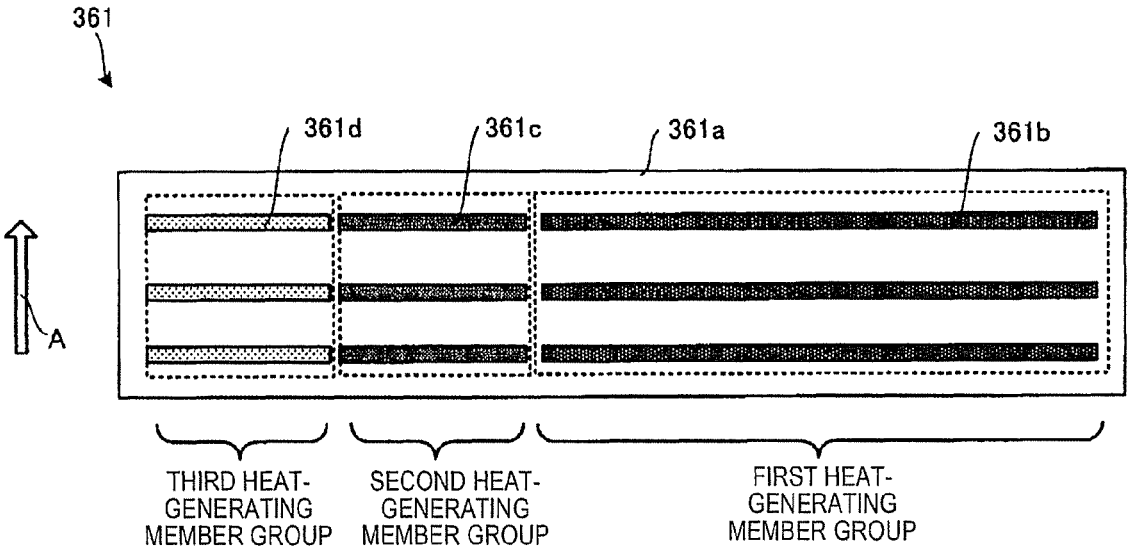
FIG. 8 is an arrangement diagram of another pattern of the heat-generating member groups according to Embodiment 1.

In order to conduct all exposure portions (heat-generating member) of the plurality of heat-generating resistors which are lined up in the transport direction, at the same time, as illustrated in FIG. 7C, wirings 361*g* are linked to the aluminium layer 361*f* on both ends and are linked to a driving IC (switching driver IC) 151. In order to cover all of the heat-generating resistor layers (361*b*, 361*c*, and 361*d*), the aluminium layer 361*f*, the wiring 361*g*, and the like, a protective layer 361*h* is formed on the top portion. The protective layer 361*h* is formed of $Si_3N_4$ and the like, for example. In FIGS. 5 to 6B, the forming method of the heat-generating member when paper which is aligned at the center is transported is described. However, similar description when the protective layer 361*h* is formed to correspond to a case where paper aligned on one side is transported as illustrated in FIG. 8 will also be made.

Figure 9:
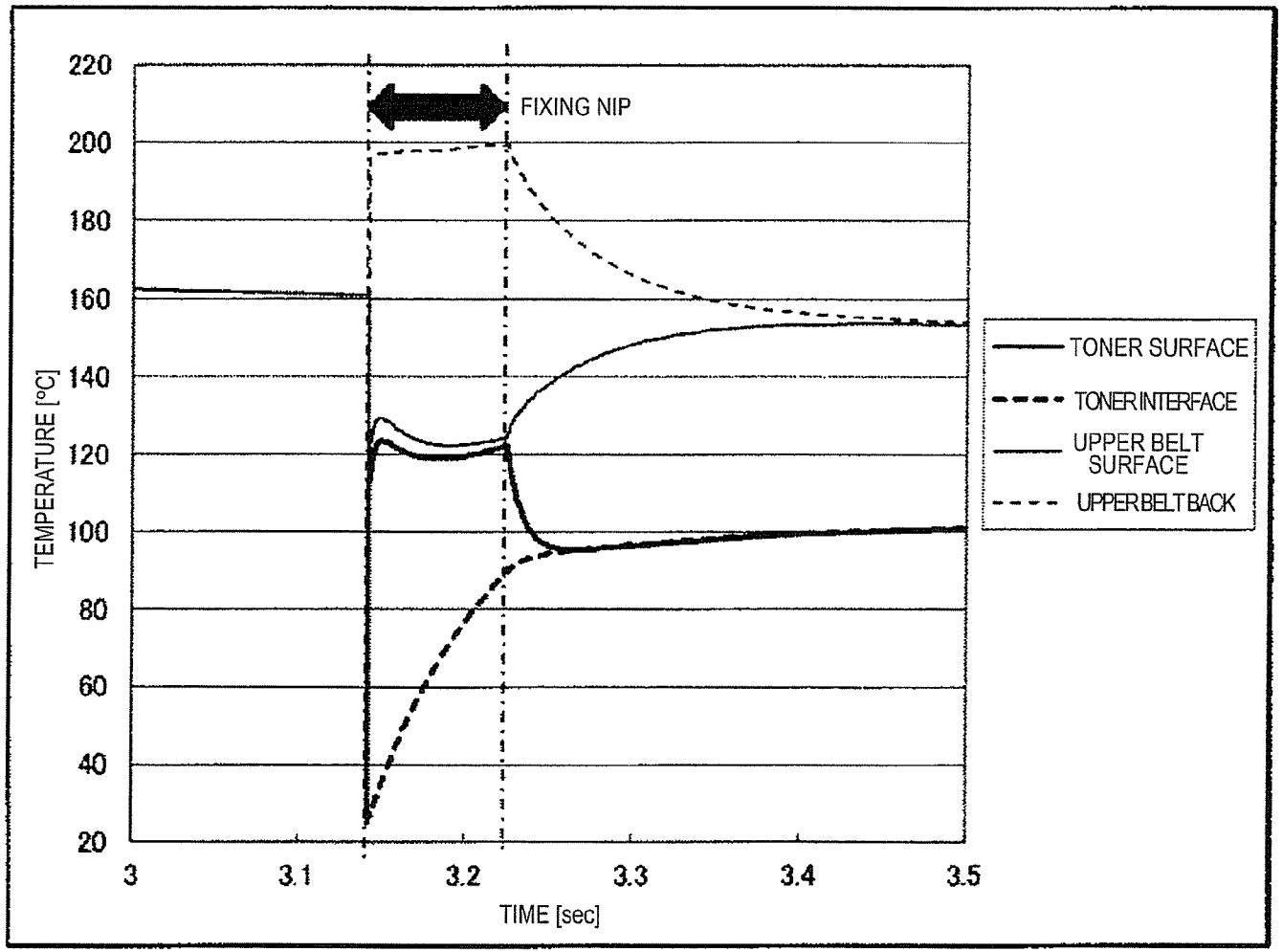
FIG. 9 is a diagram illustrating a result of simulation of the temperature of a toner on paper and the surface temperature of a fixation belt.

FIG. 9 is a diagram illustrating a result of thermal simulation of the temperature of a toner on paper and the surface temperature of the fixation belt (endless belt 363). FIG. 9 illustrates a result of simulating a fixation condition when a toner which has a fixable temperature range from 80° C. to 130° C. and is mounted in the MFP is used. If a processing speed of a printing device is 120 mm/sec and the width of the heating member (=the width of the fixing nip) is 10 mm, a heating time of a recording material containing non-fixed toner is about 83 msec. Ina condition for forming a full-colored high density image, for example, the maximum thickness of a toner layer is 20 um and the thickness is, for example, 270 um in a case of using a thick recording material such as a tack sheet.

The following is understood. When it is assumed that the entire surface of the heating member 361 is uniformly heated under the above conditions, a belt surface temperature reaches 160° C. in about 3 seconds from the start of conduction (POWER ON). When a recording material (toner particles) at 25° C. is heated by using the nip for 83 msec, the temperature of a portion (=toner interface) at which a toner and a recording paper are brought into contact with each other reaches a fixable temperature of 80° C. or more. Since a temperature rising speed at this portion is determined by a material and the thickness of the recording material, it is difficult to reduce a heating time by reducing the size of the nip (=width of the heating member) for a reduced-sized apparatus. As it is understood that a belt back surface temperature rises up to 200° C., since the heating member 361 is brought directly into contact with a back of the belt, if only the vicinity of a nip portion is heated, it is possible to significantly reduce a time required for increasing the temperature of a fixing nip portion up to a required temperature. On the contrary, if an elastic layer is formed on a surface of the belt, temperature gradient occurs between the surface and a back surface of the belt and the temperature on the back surface is considerably higher than the temperature on the surface. The elastic layer is necessarily required such that adhesion of the belt surface and the recording material (toner particles) is improved and heat is transferred with high efficiency. In order to prevent thermal deterioration of the elastic layer, a heating condition of causing the back surface to have a high temperature is inappropriate. Accordingly, in this embodiment, fixation is performed under a heating condition of a toner interface temperature being 80° C. or more and the belt back surface temperature being 220° C. or less which is the heat-resistant upper limit temperature of the elastic layer.

Figure 10:
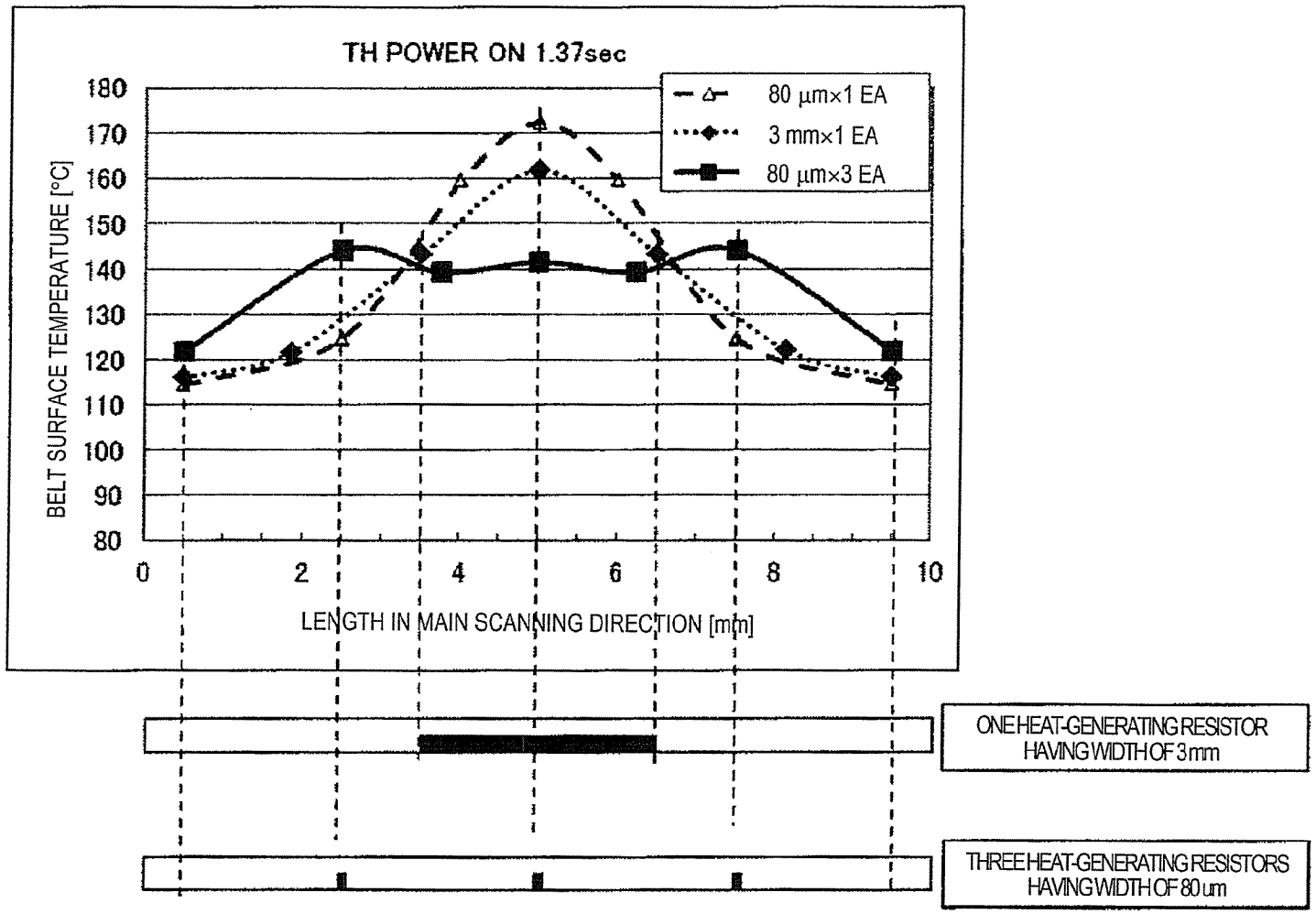
FIG. 10 is a diagram illustrating a result of simulating the size of an exposed portion of a heat-generating resistor in the heating member and surface temperature distribution in accordance with the number of heat-generating resistors.

FIG. 10 is a diagram illustrating a result of thermal simulation of surface temperature distribution in accordance with the size and the number of the exposure portions of the heat-generating resistors in the heating member 361. In order to determine the arrangement of the heat-generating resistors (exposure portions) on the surface of the heating member 361, temperature uniformity on the surface of the heating member is calculated by changing the size of the heat-generating resistor. When one heat-generating resistor of 80 um is provided at the center portion, it is understood that the maximum surface temperature of the heating member 361 is 170° C. and the minimum is 110° C. at a time point of about 1.4 secs after the start of conduction (POWER ON) and a temperature difference is significantly large. When one heat-generating resistor having a width widened to 3 mm is provided, nonuniformity of the temperature is not solved. However, it is understood that a plurality of heat-generating resistors having a width of 80 um are disposed at a set interval on the surface of the heating member, and thus nonuniformity of the temperature is considerably improved. From this, the plurality of heat-generating members being disposed in the transport direction is effective.

Figure 11A:
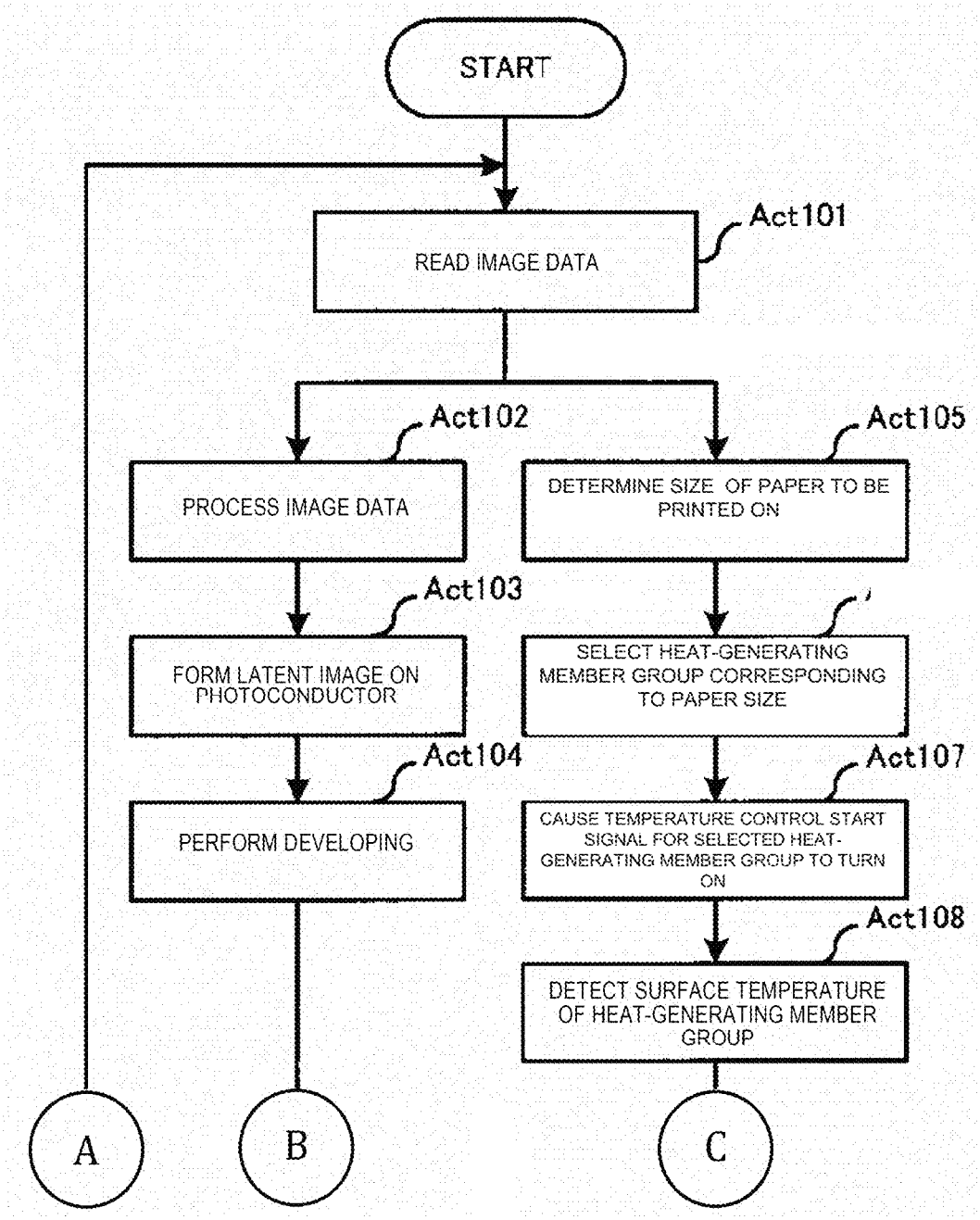
FIGS. 11A to 11C are flowcharts illustrating a specific example of a control operation of the MFP according to Embodiment 1.
Figure 11B:
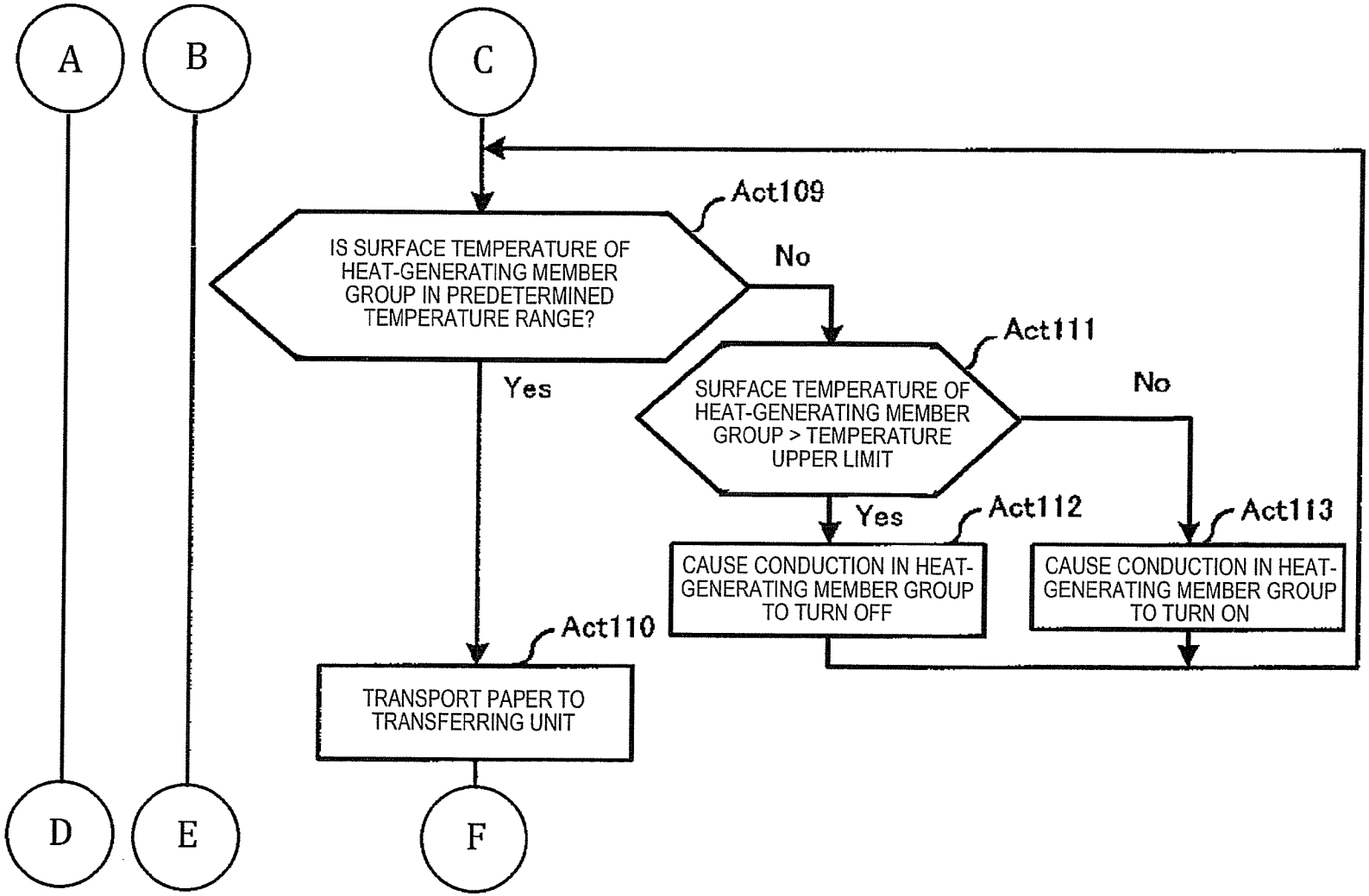
Figure 11C:
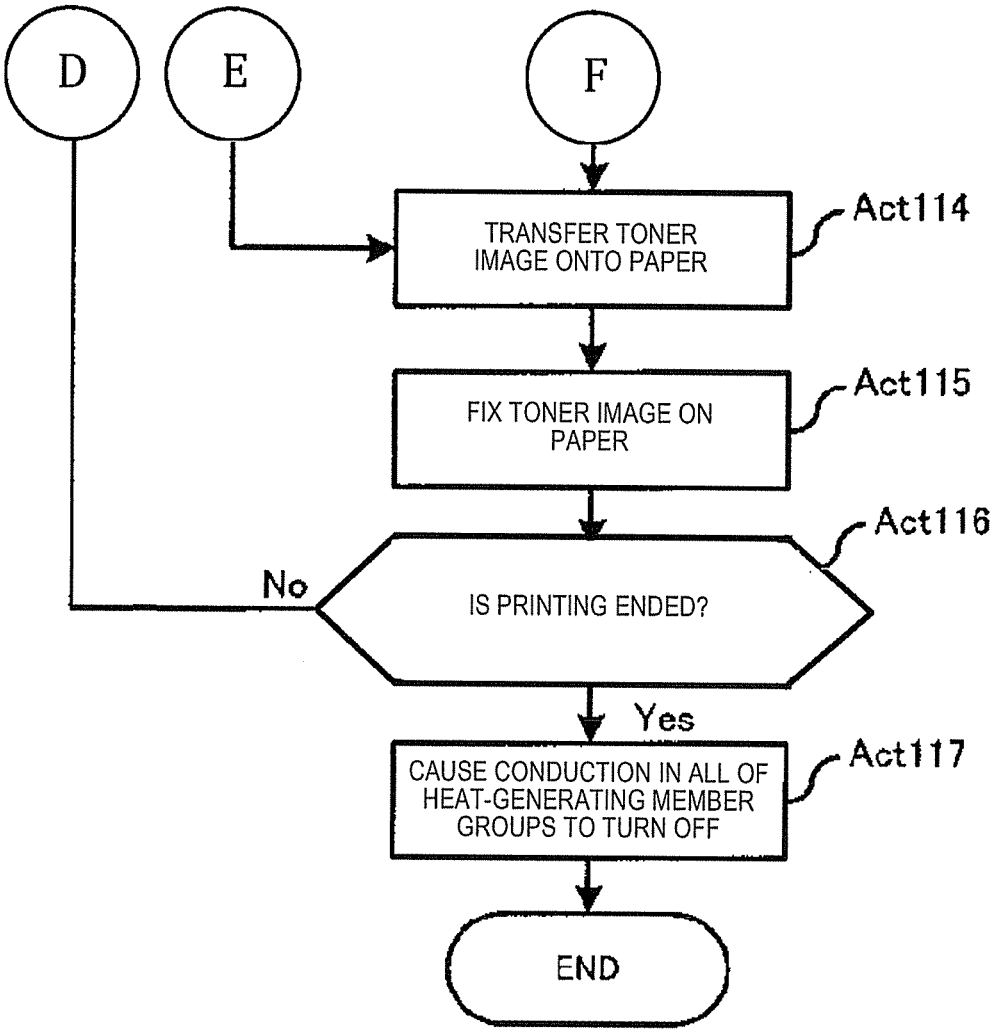

Hereinafter, an operation of the MFP 10 having the above-described configuration when printing is performed will be described based on the drawings. FIGS. 11A to 11C are flowcharts illustrating a specific example of control of the MFP 10 in Embodiment 1.

First, if the scanner unit 15 reads image data (Act101), an image forming control program in the image forming unit 20 and the fixing temperature control program in the fixing device 36 are executed in parallel.

If image forming processing is started, the read image data is processed (Act 102) and an electrostatic latent image is formed on the surface of the photoconductive drum 22 (Act 103). The developing device 24 develops the electrostatic latent image (Act 104), and then the process proceeds to Act 114.

If fixing temperature control processing is started, a paper size is determined based on a detection signal of the line sensor (not illustrated) (Act 105) and the heat-generating member group which is disposed at a position through which the paper P passes is selected as a heating target (Act 106). For example, when the paper P has the minimum size (postcard size), the first heat-generating member group which is disposed at the center is selected. As the size of the paper P is increased, the second heat-generating member group and the third heat-generating member group are selected along with the first heat-generating member group.

If a temperature control start signal which is applied to the heat-generating member group selected in Act 106 turns ON (Act 107), the selected heat-generating member group is conducted and the surface temperature of the conducted heat-generating member group is increased.

If the temperature sensing member (not illustrated) which is disposed on the inside or the outside of the endless belt 363 detects the surface temperature of the heat-generating member group (Act 108), it is determined whether or not the surface temperature of the heat-generating member group is in a predetermined temperature range (Act 109). When it is determined that the surface temperature of the heat-generating member group is in a predetermined temperature range (Yes in Act 109), the process proceeds to Act 110. On the other hand, when it is determined that the surface temperature of the heat-generating member group is not in a predetermined temperature range (No in Act 109), the process proceeds to Act 111.

In Act 111, it is determined whether or not the surface temperature of the heat-generating member group exceeds a predetermined temperature upper limit value. When it is determined that the surface temperature of the heat-generating member group exceeds a predetermined temperature upper limit value (Yes in Act 111), a conduction state of the heat-generating member group selected in Act 106 turns OFF (Act 112) and the process returns to Act 108. On the other hand, when it is determined that the surface temperature of the heat-generating member group does not exceed a predetermined temperature upper limit value (No in Act 111), it means a state where the surface temperature does not reach a predetermined temperature lower limit value by a determination result in Act 109, and thus the heat-generating member group maintains the conduction state of ON or turns ON again (Act 113). The process returns to Act 108.

If the paper P is transported to a transferring unit in a state where the surface temperature of the heat-generating member group is in the predetermined temperature range (Act 110), a toner image is transferred onto the paper P (Act 114), and then the paper P is transported into the fixing device 36.

If the toner image is fixed onto the paper P in the fixing device 36 (Act 115), it is determined whether or not printing processing of image data is ended (Act 116). When it is determined that the printing processing is ended (Yes in Act 116), the conduction state of all of the heat-generating member groups turns OFF (Act 117), and the process is ended. On the other hand, when it is determined that the printing processing of the image data is not ended (No in Act 116), that is, when image data to be printed remains, the process returns to Act 101 and similar processing is repeated until the process is ended.

In this manner, in the fixing device 36 according to this embodiment, the heat-generating resistors (heat-generating member) which constitute the heating member 361 are two-dimensionally arranged in the paper transport direction and the main scanning direction in such a manner that the heat-generating resistors are lined up along two parallel lines or more in the direction (main scanning direction) vertical to the paper transport direction and are divided at locations on the parallel lines corresponding to each other. Whether or not a group of the heat-generating members which are lined up in the paper transport direction is conducted at the same time is controlled. As illustrated in FIG. 10, since the heat-generating members are heated at a plurality of locations which are separated by a constant distance in the transport direction, it is possible to adjust the temperature when heating is performed, so as to be uniform. As a result, it is possible to improve fixation quality. Even though small-sized paper and large-sized paper are mixed and printed, a heat-generating area is switched based on the small and large sized paper to be printed on, and thus it is possible to prevent abnormal heat generation at a non-passing portion and to suppress useless heating at the non-passing portion. Thus, it is possible to greatly reduce the amount of thermal energy consumed by the fixing device 36. A printing portion is able to be stably heated in a concentrated manner and thus it is possible to improve fixation quality.

Embodiment 2

Hereinafter, a fixing device 36 according to Embodiment 2 will be described based on the drawings. In this embodiment, the configuration of the MFP 10 is substantially similar to that in the Embodiment 1 and the same reference numerals represent the same components as those in Embodiment 1. In the following descriptions, points different from those in Embodiment 1 are focused on and will be described.

Figure 12A:
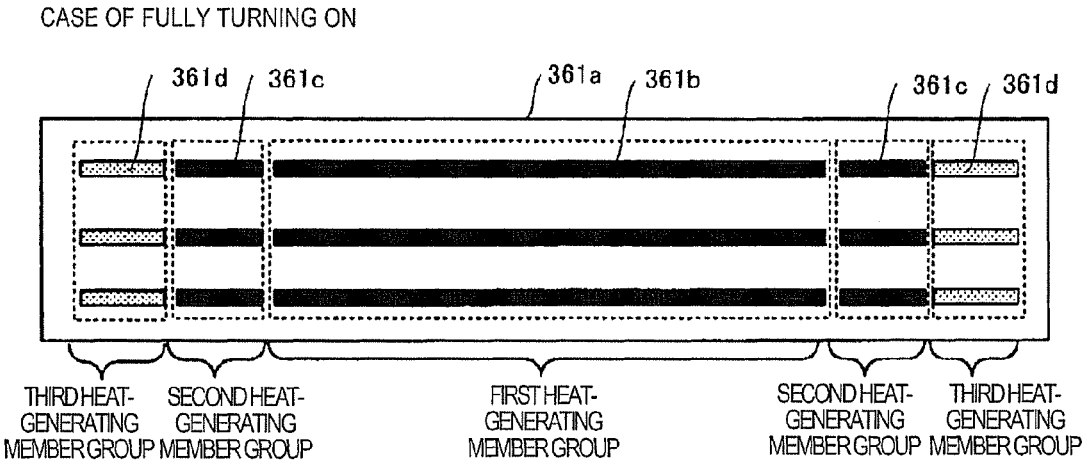
FIGS. 12A and 12B are top views illustrating an example of a heating pattern of heat-generating member groups according to Embodiment 2.
Figure 12B:
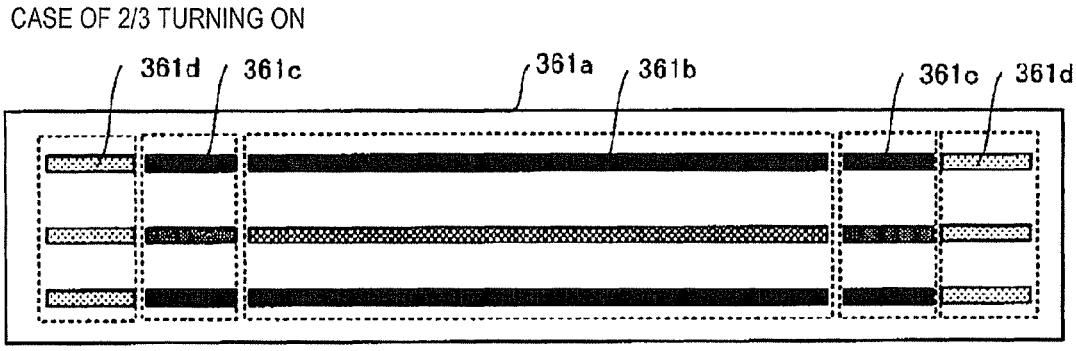

FIGS. 12A and 12B are arrangement diagrams of heat-generating member groups in Embodiment 2. Two conduction patterns when the paper size is B5R size (182×257 mm) will be described as an example. In FIG. 12A, all of the first heat-generating member group and the second heat-generating member group are conducted and a state of fully turning on occurs. On the other hand, in a case of FIG. 12B, heat-generating members of a second line are controlled not to be conducted and a state of ⅔ turning on occurs. Control as in FIG. 12B is performed, for example, when the thickness of paper to be used is thinner than general type paper, when the surface temperature of the heat-generating member group is sufficiently high, or the like. Embodiment 2 is different from Embodiment 1 in that conduction of the heat-generating members is not controlled in a unit of a group of heat-generating members which are lined up in the paper transport direction, and is individually controlled.

Figure 13A:
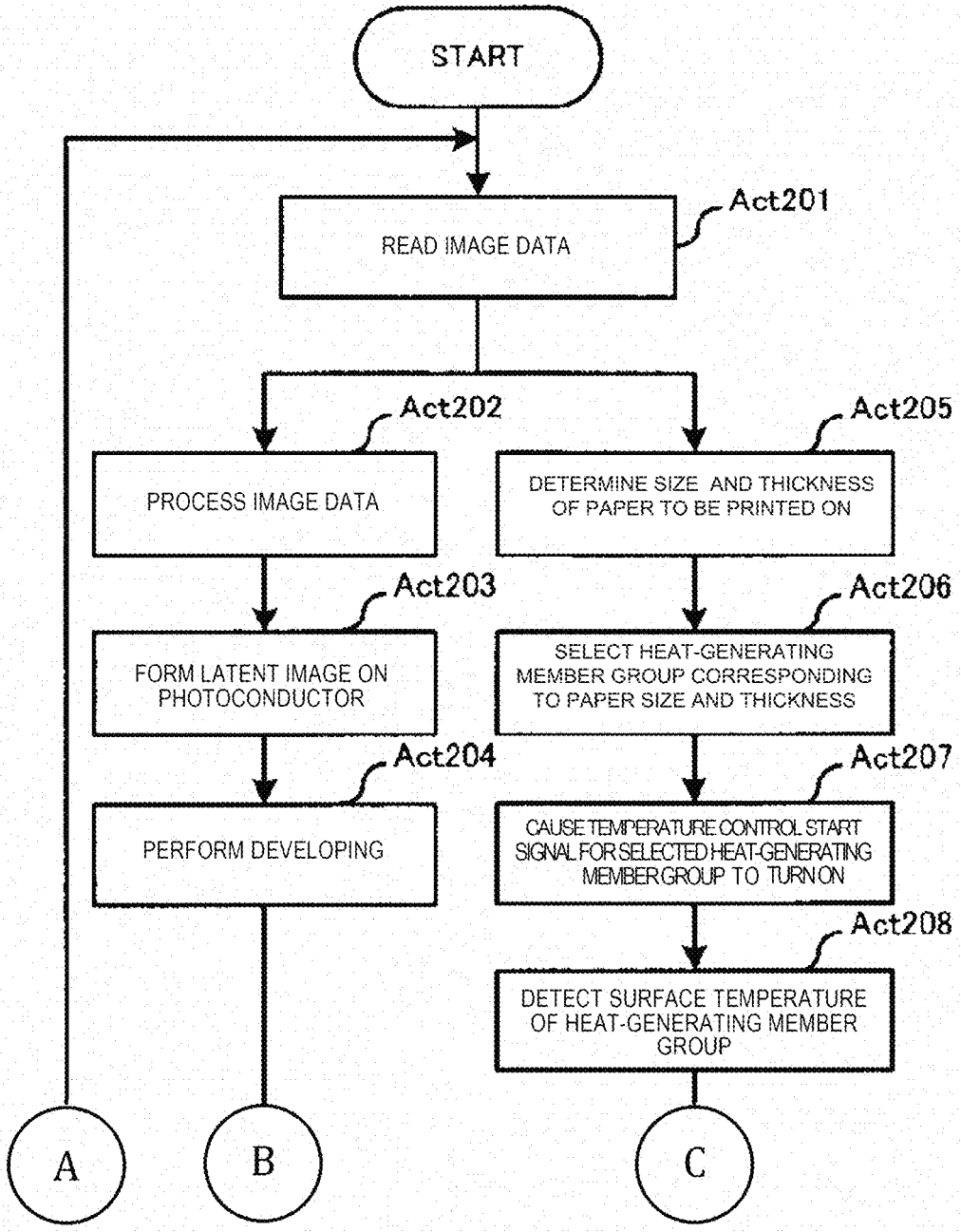
FIGS. 13A to 13C are flowcharts illustrating a specific example of a control operation of an MFP according to Embodiment 2.
Figure 13B:
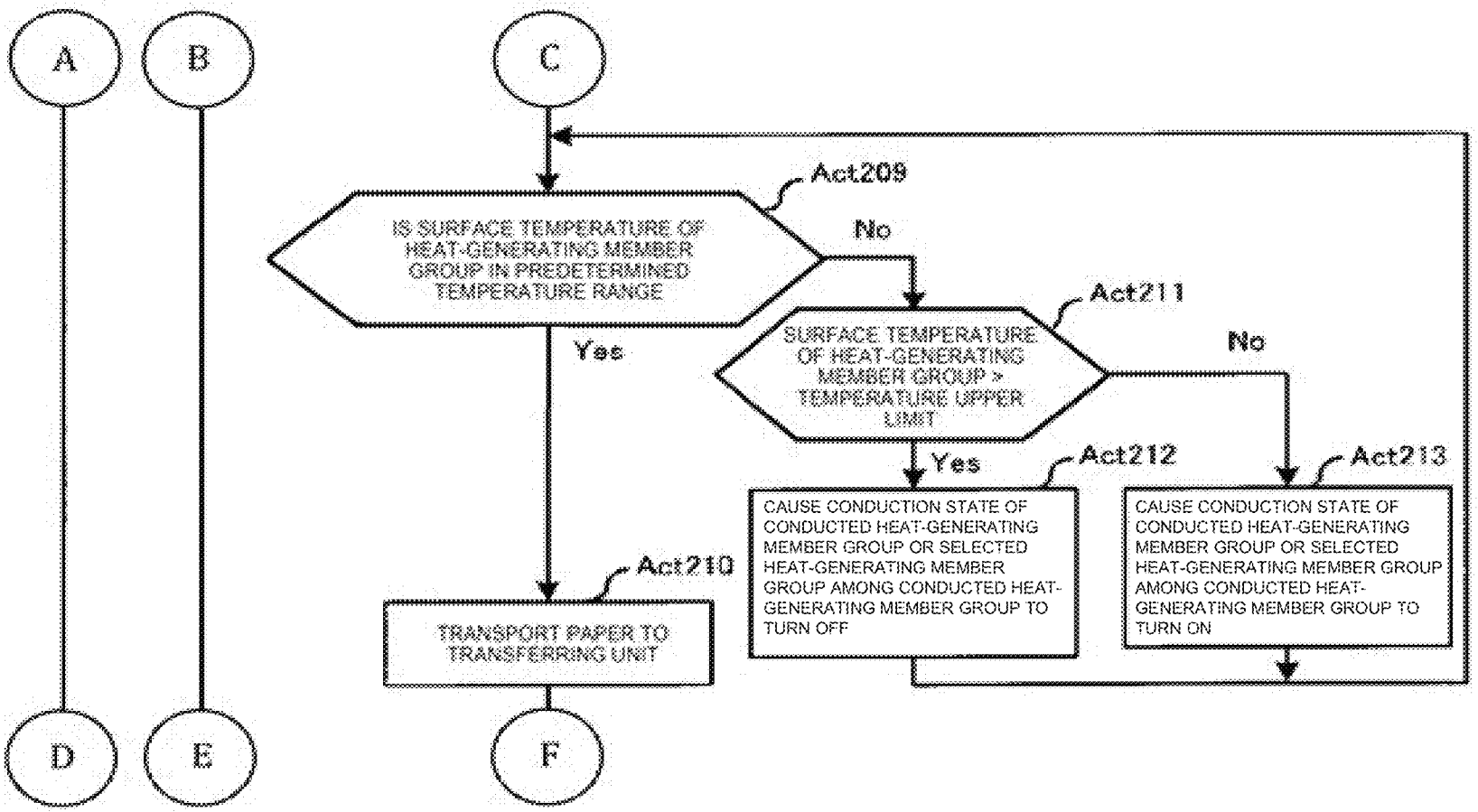
Figure 13C:
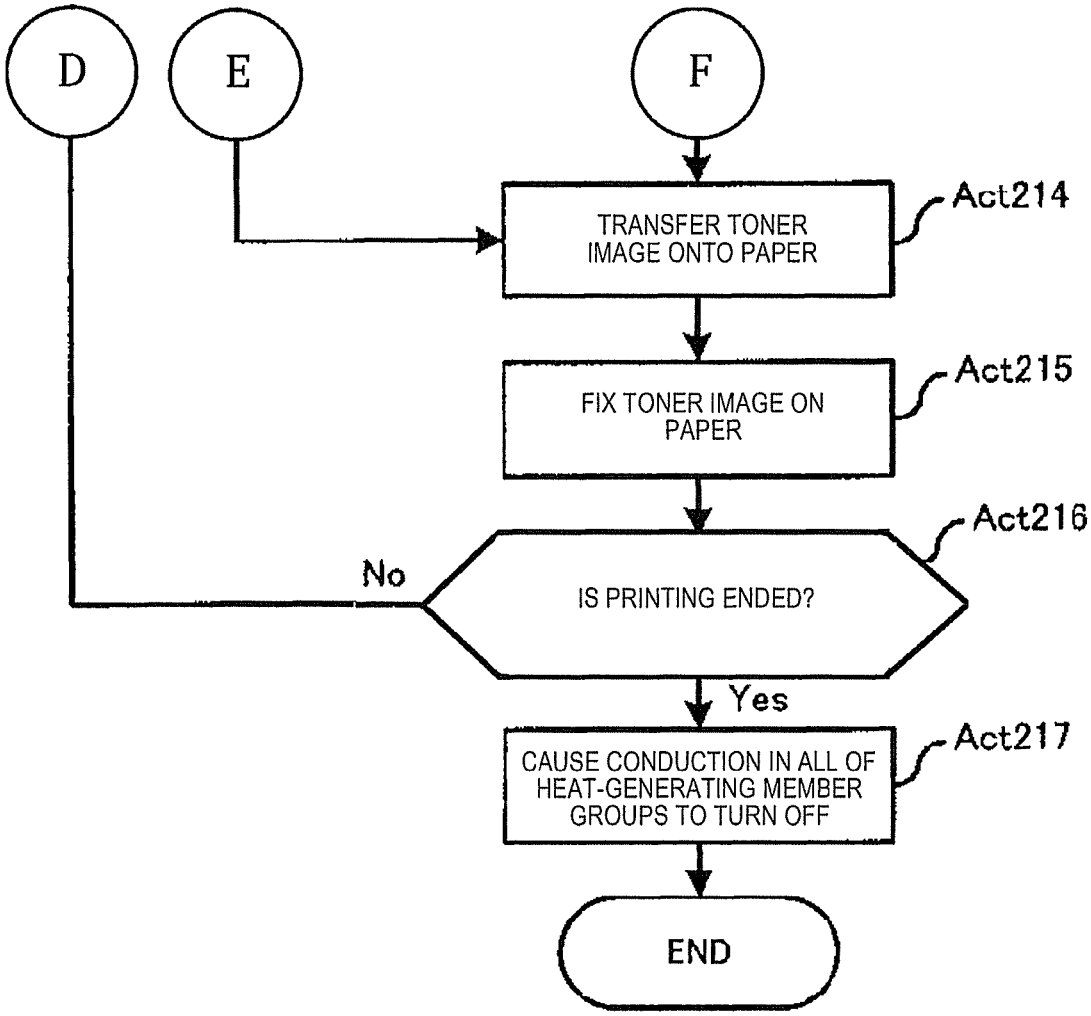

Hereinafter, an operation of the MFP 10 according to this embodiment when printing is performed will be described based on the drawings. FIGS. 13A to 13C are flowcharts illustrating a specific example of control of the MFP 10 in Embodiment 2.

First, if the scanner unit 15 reads image data (Act 201), the image forming control program in the image forming unit 20 and the fixing temperature control program in the fixing device 36 are executed in parallel.

If the image forming processing is started, the read image data is processed (Act 202) and an electrostatic latent image is formed on the surface of the photoconductive drum 22 (Act 203). The developing device 24 develops the electrostatic latent image (Act 204), and then the process proceeds to Act 214.

If the fixing temperature control processing is started, a paper size and the thickness of paper are determined based on detection signals of the line sensor (not illustrated) and a sound wave sensor (not illustrated) (Act 205). Heat-generating members to be heated are selected among the heat-generating member group which is disposed at a position through which the paper P passes, based on the determined paper size and thickness of paper (Act 206). For example, when the paper P has the minimum size (postcard size), the first heat-generating member group which is disposed at the center is selected. As the size of the paper P is increased, the second heat-generating member group and the third heat-generating member group are added. Even though the paper size is the same, when the thickness of paper is general thickness or thicker based on the thickness of the paper, the heat-generating members are caused to fully turn on. When the thickness of paper is thin, a heat-generating member which is not to be conducted is appropriately determined among the heat-generating members which belong to the same group such that the state of turning on is ⅓ or ⅔. It is preferable that a control condition when non-conduction is performed is pre-defined and stored in a storage device such as the MFP 10. The thickness of paper may be selected and designated from a user interface by a user without a sensor for determination.

If a temperature control start signal which is applied to the heat-generating member group selected in Act 206 turns ON (Act 207), the selected heat-generating member group is conducted and the surface temperature of the conducted heat-generating member group is increased.

If the temperature sensing member (not illustrated) which is disposed on the inside or the outside of the endless belt 363 detects the surface temperature of the heat-generating member group (Act 208), it is determined whether or not the surface temperature of the heat-generating member group is in a predetermined temperature range (Act 209). When it is determined that the surface temperature of the heat-generating member group is in a predetermined temperature range (Yes in Act 209), the process proceeds to Act 210. On the other hand, when it is determined that the surface temperature of the heat-generating member group is not in a predetermined temperature range (No in Act 209), the process proceeds to Act 211.

In Act 211, it is determined whether or not the surface temperature of the heat-generating member group exceeds a predetermined temperature upper limit value. When it is determined that the surface temperature of the heat-generating member group exceeds a predetermined temperature upper limit value (Yes in Act 211), a conduction state of the heat-generating member group selected in Act 206 turns OFF (Act 212) and the process returns to Act 208. On the other hand, when it is determined that the surface temperature of the heat-generating member group does not exceed a predetermined temperature upper limit value (No in Act 211), it means a state where the surface temperature does not reach a predetermined temperature lower limit value by a determination result in Act 209, and thus the heat-generating member group maintains the conduction state of ON or turns ON again (Act 213). The process returns to Act 208. In Acts 212 and 213, in order to adjust a rising speed and a falling speed, it is possible to appropriately change a proportion of heat-generating members which turn ON/OFF among the heat-generating member group to be controlled in accordance with a difference value between the surface temperature of the heat-generating member group and the fixing temperature. For example, when a temperature difference is small, it is preferable that conduction is controlled such that ⅓ turning on is performed instead of fully turning on.

If the paper P is transported to the transferring unit in a state where the surface temperature of the heat-generating member group is in the predetermined temperature range (Act 210), a toner image is transferred onto the paper P (Act 214), and then the paper P is transported into the fixing device 36.

If the toner image is fixed onto the paper P in the fixing device 36 (Act 215), it is determined whether or not printing processing of image data is ended (Act 216). When it is determined that the printing processing is ended (Yes in Act 216), the conduction state of all of the heat-generating member groups turns OFF (Act 217), and the process is ended. On the other hand, when it is determined that the printing processing of the image data is not ended yet (No in Act 216), that is, when image data to be printed remains, the process returns to Act 201 and similar processing is repeated until the process is ended.

In this manner, in the fixing device 36 according to this embodiment, heat-generating members to be conducted are selected among the heat-generating member group which is disposed at a position through which the paper P passes, based on the determined paper size and thickness of paper, and thus conduction is controlled delicately compared to a case of Embodiment 1. Accordingly, effects are obtained in that it is possible to suppress excessively heating paper compared to the case of Embodiment 1 and energy' saving is obtained.

In the above-described embodiments, the length of the heat-generating member group in the paper transport direction and a material of the heat-generating member group are uniform. However, the length, the thickness and material of each of the heat-generating members may be changed such that the heat-generating member which is disposed on the upstream side of the transport direction is heated more than the heat-generating member which is disposed on the downstream side by the same conduction amount.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the configurations of Embodiment 1 and Embodiment 2 may be combined. That is, a heat-generating member group may be selected based on the magnitude of a printing size (image forming area) which is the same as in Embodiment 1 instead of the paper size in Embodiment 2.

What is claimed is:

1. A fixing device comprising:

a detector determining a size of a medium on which a toner image is formed;

a heater including an endless rotating body, a plurality of heat-generating members, and a switching unit, and for heating the medium, the plurality of heat-generating members being two-dimensionally arranged in such a manner that the heat-generating members are lined up along two parallel lines or more which are vertical to a transport direction of the medium and divided at locations on the parallel lines corresponding to each other, and are disposed so as to come into contact with an inner side of the rotating body, and the switching unit switching individual conduction of these heat-generating members;

a pressing roller forming a nip by performing pressing and contact at a position of the plurality of heat-generating members in the heater, and for nipping and carrying the medium in the transport direction with the heater; and a heater controller selecting a group of the heat-generating members which corresponds to a position through which the medium passes based on the size of the medium which is determined by the detector, the group of the heat-generating members being lined up in the transport direction in the two-dimensional arrangement, for conducting the selected group of the heat-generating members by the switching unit, and for controlling the heater to heat the medium at the same time.

2. The device according to claim 1, wherein the detector determines the size and the thickness of the medium, and the heater controller selects heat-generating members which are not to be conducted, among the heat-generating members corresponding to the position through which the medium passes based on a result of the determination and suppresses heating of the heater according to the thickness.

3. The device according to claim 1, wherein the plurality of heat-generating members are heated in such a manner that the temperature on an upstream side of the transport direction is higher than the temperature on a downstream side.

4. The device according to claim 1, wherein the plurality of heat-generating members are formed in such a manner that the length of the heat-generating members on an upstream side in the transport direction is longer than the length of the heat-generating members on a downstream side in the transport direction.

5. A fixing temperature control method of a fixing device which includes a plurality of heat-generating members having a two-dimensional arrangement in such a manner that the heat-generating members are lined up along two parallel lines or more which are vertical to a transport direction of a medium and are divided at locations on the parallel lines corresponding to each other, and a switching unit individually switching these heat-generating members to be conducted, and which heats the medium to fix a toner image on the medium, the method comprising:

determining a size of the medium; and controlling the heat-generating members to heat the medium by selecting a group of the heat-generating members based on the determined size of the medium, the group of the heat-generating members corresponding to a position through which the medium passes and being lined up in the transport direction in the two-dimensional arrangement and conducting the selected heat-generating members by the switching unit at the same time.

* * * * *